US012345143B1

(12) United States Patent
Alfaraj et al.

(10) Patent No.: US 12,345,143 B1
(45) Date of Patent: Jul. 1, 2025

(54) ENHANCED DEEP MICRO-FRACTURING TOOL USING LASER BEAMS AND ACOUSTIC WAVES

(71) Applicant: SAUDI ARABIAN OIL COMPANY, Dhahran (SA)

(72) Inventors: Rima T. Alfaraj, Dhahran (SA); Hassan Sakar Alqahtani, Dhahran (SA); Murtadha J. Altammar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/664,177

(22) Filed: May 14, 2024

(51) Int. Cl.
*E21B 43/26* (2006.01)
*E21B 49/08* (2006.01)

(52) U.S. Cl.
CPC ..... *E21B 43/26* (2013.01); *E21B 49/08* (2013.01)

(58) Field of Classification Search
CPC ..... E21B 43/26; E21B 49/08; E21B 28/00; E12B 43/003
See application file for complete search history.

(56) References Cited

U.S. PATENT DOCUMENTS 8,417,457 B2 4/2013 Franquet
9,057,232 B2 * 6/2015 Cioanta ..... C09K 8/52
9,140,109 B2 9/2015 Suarez-Rivera et al.
9,557,434 B2 1/2017 Keller et al.
9,951,585 B1 * 4/2018 Volk ..... E21B 43/26
9,982,531 B2 5/2018 Johnston
10,087,722 B2 10/2018 Lecerf et al.
10,465,505 B2 11/2019 Disko et al.
11,028,647 B2 6/2021 Batarseh
11,225,856 B2 * 1/2022 Clark ..... E21B 28/00
11,236,597 B2 * 2/2022 Hamza ..... C09K 8/80
11,767,738 B1 * 9/2023 Altammar ..... E21B 43/003 166/308.1
2013/0146281 A1 6/2013 Noui-Mehidi et al.
2024/0401445 A1 * 12/2024 Khan ..... E21B 49/08

* cited by examiner

*Primary Examiner* — Kenneth L Thompson
(74) *Attorney, Agent, or Firm* — Vorys, Sater, Seymour and Pease LLP

(57) ABSTRACT

A well system includes a wellbore extending from a wellhead and penetrating a producible reservoir and a downhole assembly extendable into the wellbore and including a laser component operable to emit a laser beam into the producible reservoir to induce a first plurality of micro-fractures extending radially outward from the wellbore. The downhole assembly includes a stimulation tool that includes an acoustic component including one or more acoustic generators operable to generate and propagate acoustic waves into the producible reservoir and thereby induce a second plurality of micro-fractures extending radially outward from the wellbore, and one or more acoustic receivers operable to detect and receive reflected acoustic waves returned back from the producible reservoir. The downhole assembly includes a fluid sampling component operable to extract fluid samples from the wellbore at locations radially adjacent the producible reservoir wherein data related to the reflected acoustic waves and the fluid samples is analyzed to characterize the first and second pluralities of micro-fractures.

20 Claims, 2 Drawing Sheets

ENHANCED DEEP MICRO-FRACTURING TOOL USING LASER BEAMS AND ACOUSTIC WAVES

FIELD OF THE DISCLOSURE

The present disclosure relates generally to wellbore stimulation treatment tools used in the oil and gas industry for the purpose of enhancing production and, more particularly, to a downhole tool including a laser stimulation component and an acoustic component operable to generate deep micro-fractures and sample reservoir fluid.

BACKGROUND OF THE DISCLOSURE

In wells already producing hydrocarbons, a reduction in overall production may be observed over time. Often this is due to a loss of permeability within the reservoir, which may be a result of the reaction between the producible reservoirs and the drilling and/or completion fluids within the wellbore as it produces. In other cases, the producible reservoirs may be disposed within tight or unconventional formations where permeability is naturally low or nonexistent.

Methods of wellbore stimulation may be implemented to either increase or initiate permeability. In unconventional formations, stimulation treatments can create permeability where there was previous none (or little). However, portions of unconventional reservoirs may remain unstimulated even after treatment because of their deeply positioned locations.

A tool and method capable of targeting and stimulating permeability at greater depths of penetration in tight and unconventional formations is desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a wellbore extending from a wellhead and penetrating a producible reservoir and a downhole assembly extendable into the wellbore. The downhole assembly may include a laser component operable to emit a laser beam into the producible reservoir to induce a first plurality of micro-fractures extending radially outward from the wellbore and a stimulation tool that includes an acoustic component including one or more acoustic generators operable to generate and propagate acoustic waves into the producible reservoir and thereby induce a second plurality of micro-fractures extending radially outward from the wellbore, and one or more acoustic receivers operable to detect and receive reflected acoustic waves returned back from the producible reservoir. The downhole assembly may include a fluid sampling component operable to extract fluid samples from the wellbore at locations radially adjacent the producible reservoir, wherein data related to the reflected acoustic waves and the fluid samples is analyzed to characterize the first and second pluralities of micro-fractures.

According to an embodiment consistent with the present disclosure, a wellbore stimulation method may include conveying a downhole assembly into a wellbore penetrating a producible reservoir. the downhole assembly may include a laser component that includes a laser generator and a stimulation tool that includes an acoustic component including one or more acoustic generators and one or more acoustic receivers and a fluid sampling component. The method may include aligning the laser stimulation tool with the producible reservoir within the wellbore, emitting a laser beam from the laser generator and thereby generating a first plurality of micro-fractures in the producible reservoir and extracting and analyzing a first fluid sample from the wellbore with the fluid sampling component at a location adjacent to the producible reservoir. The method may include emitting a plurality of acoustic waves from the one or more acoustic generators and thereby generating a second plurality of micro-fractures in the producible reservoir, receiving a plurality of reflected acoustic waves with the one or more acoustic receivers from the producible reservoir and extracting and analyzing a second fluid sample from the wellbore with the fluid sampling component at the location. The method may include analyzing the plurality of reflected acoustic waves and the first and second fluid samples and characterizing the first and second plurality of micro-fractures generated in the producible reservoir based on data obtained by the plurality of reflected acoustic waves and the first and second fluid samples.

According to an embodiment consistent with the present disclosure, a downhole assembly may include a laser component that includes a laser generator operable to generate and emit a laser beam into a producible reservoir and thereby induce a first plurality of micro-fractures and a stimulation tool. The stimulation tool may include an acoustic component including one or more acoustic generators operable to generate and propagate acoustic waves and thereby induce a second plurality of micro-fractures in the producible reservoir and one or more acoustic receivers operable to detect and receive reflected acoustic waves returned back from the one or more producible reservoirs and a fluid sampling component operable to extract fluid samples from the wellbore at locations radially adjacent to the one or more producible reservoirs.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
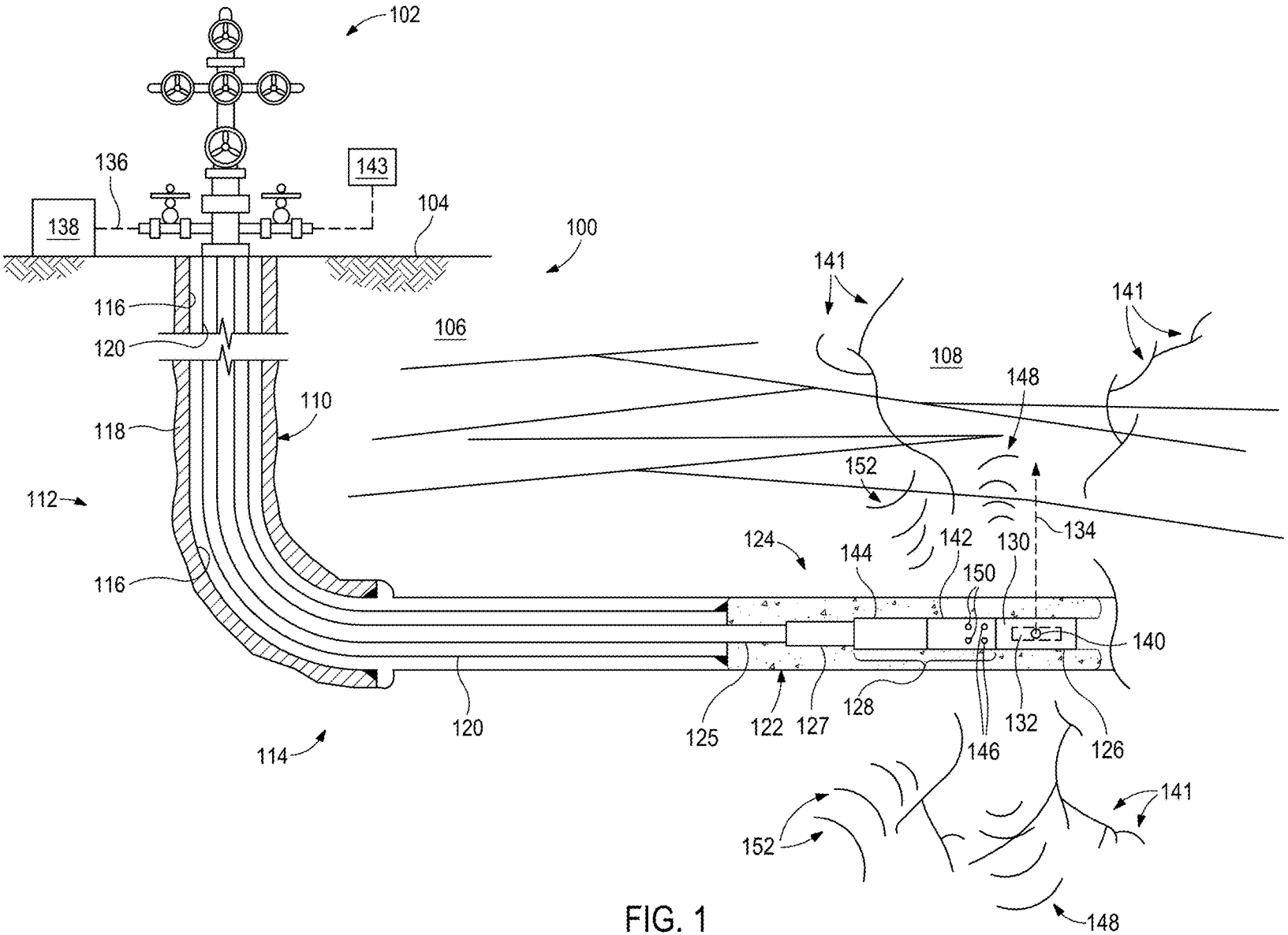
FIG. 1 is a schematic of an example well system, according to one or more embodiments.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure relate generally to wellbore stimulation treatment tools used in the oil and gas industry for the purpose of enhancing hydrocarbon production and, more particularly, to a downhole tool capable of generating micro-fractures both by laser and acoustic waves. The downhole tool described herein includes components capable of generating laser beams operable to initiate (and/or propagate) micro-fractures in a reservoir. The downhole tool also includes an acoustic component capable of emitting acoustic waves at varying frequencies to initiate deep micro-fractures and/or propagate the micro-fractures created by the laser component of the downhole tool. With the aforementioned components, the downhole tool is capable of generating micro-fractures deep within unconventional formations lacking permeability but still comprising producible reservoirs. The micro-fractures increase (or initiate) permeability and may enhance the overall production capabilities of unconventional, but producible, reservoirs. The downhole tool can also include a component capable of sampling reservoir fluids. The reservoir fluids may be analyzed for formation information. A method described herein discloses implementation of an acid treatment following the deployment of the downhole tool. The acid treatment may be operable to further enhance the generated micro-fractures. The downhole tool and methods described herein are operable to increase formation permeability and, as a result, production. In addition, the downhole tool and stimulation method described may be less costly in comparison to other well-known stimulation treatments and methods.

FIG. 1 is a schematic diagram of an example well system 100 that may employ one or more principles of the present disclosure. In the illustrated embodiment, the well system 100 includes a wellhead 102 located at a terranean surface 104 (alternately referred to as a "well surface") and centered over a submerged oil and gas subterranean formation 106 comprising one or more producible reservoirs 108. The embodiments and operations disclosed herein may be carried out with or without the use of a service rig, in either offshore or onshore locations. In the example embodiment, a service rig is not used and instead the operations may be carried out with well-intervention equipment deemed necessary by the well operator (rigless operations). Rigless operations may include, but are not limited to, coiled tubing, snubbing, wireline, and slickline. In embodiments in which a service rig is desirable, the service rig may include, but is not limited to a drilling rig, a completion rig, a workover rig, or any combination thereof.

As illustrated in FIG. 1, a wellbore 110 extends from the wellhead 102 and through various earth strata including the formation 106 and the producible reservoirs 108. In the example, the wellbore 110 has an initial, generally vertical portion 112 and a lower, generally deviated portion 114. The wellbore 110 may be lined with one or more strings of casing 116 cemented within the wellbore 110 using cement 118. In at least one embodiment, the casing 116 may extend at least partially into the deviated portion 114. In other embodiments, one or more additional liners (not shown) may be installed within the vertical portion 112 and/or the deviated portion 114 of the wellbore 110.

A string of production tubing 120 may be positioned within the wellbore 110 and extended into the interior of the casing 116. The production tubing 120 may be operatively coupled to and extend from the wellhead 102 to a predetermined distance in the wellbore 110. In the example disclosed herein the production tubing 120 extends below the distal end of the casing 116 and into an open-hole section 122 of the wellbore 110, where the casing 116 and/or liners are omitted. As depicted in FIG. 1, the end of the production tubing 120 is positioned a distance above (uphole from) the most distal end of the wellbore 110. In other embodiments, the production tubing 120 may be positioned so that the end of the production tubing 120 is at, or near, the most distal end of the wellbore 110. The production tubing 120 provides a conduit for fluids extracted from the formation 106 and more particularly, the producible reservoirs 108, to travel to the surface 104 location for production.

The well system 100 may also include a downhole assembly 124 extendable into the wellbore 110 on a conveyance 125. The conveyance 125 may comprise any means of conveying or advancing the downhole assembly 124 into the wellbore 110, while also enabling operability of the tools included in the downhole assembly 124. Examples of the conveyance 125 include, but are not limited to, coiled tubing, coiled tubing with wire embedded, wireline, drill pipe, wired drill pipe, and the like. In some embodiments, the downhole assembly 124 may be self-powered and operated, and in such embodiments the conveyance 125 may comprise slickline. In one or more embodiments, such as in highly deviated wellbores 110, the downhole assembly 124 may further include a downhole tractor or another device to advance the downhole assembly 124 within the wellbore 110. As will be appreciated, other known means and methods may be used to advance the downhole assembly 124, including roller subs and pumping.

The downhole assembly 124 (hereinafter referred to as the "assembly 124") may include various downhole tools, devices and systems configured to undertake a number of wellbore stimulation operations, such as the creation of deep micro-fractures, as generally described herein below. While the assembly 124 is operable within the deviated portion 114, the embodiments described herein are equally applicable for use in the vertical portion 112, or any other deviated or slanted portions of the wellbore 110.

In the example embodiment, the wellbore 110 is disposed within and otherwise penetrates an unconventional formation 106, which generally lacks substantial permeability. Unconventional formations may be considered impermeable in situations where fluids embedded within the unconventional formation have no ability to travel or move within. Examples of tight or unconventional formations include but are not limited to tight sands and shales.

Methods and downhole tools currently exist to stimulate initial permeability or increase permeability of subterranean formations. Conventional methods of stimulation generally comprise either hydraulic fracturing treatments or matrix treatments. Hydraulic fracturing treatments can initiate or increase permeability in unconventional formations by inducing micro-fractures, but hydraulic fracturing often requires additional operations (e.g., perforating, mini-fracs, etc.) and in some cases, considerable amounts of equipment and materials (e.g., fracture boats/trucks, proppant, etc.) The result of which is added time and cost. Hydraulic fracturing is, however, capable of inducing micro-fractures beyond the near-wellbore region of a well; e.g., generally ranging between a few inches to a few feet extending radially outward from the wellbore 110. Alternatively, matrix treatments are generally executed to treat the near-wellbore region of a well. Matrix stimulation is generally performed for the purpose of "cleaning up" the near-wellbore area of the well in order to remove debris and/or fines that may have impeded hydrocarbon production as the well has been produced, as opposed to creating micro-fractures within a formation (unconventional or otherwise).

According to embodiments of the present disclosure, the systems and methods for generating micro-fractures in tight or unconventional formations described herein require less equipment and are therefore less costly than conventional fracture-inducing systems. Additionally, the methods disclosed allow for targeted real-time stimulation optimization thereby reducing overall operational time and cost. Micro-fractures may be created beyond the near-wellbore region to enable production from areas of tight formations not penetrable by conventional tools or methods.

As depicted in FIG. 1, the assembly 124 may include a laser component 126, a stimulation tool 128 and one or more additional downhole tools 127. Examples of the additional downhole tools 127 include but are not limited to formation evaluation tools such as, but not limited to, resistivity tools, neutron porosity tools, formation pressure measurement tools, imaging tools and the like. In some embodiments, as illustrated, the stimulation tool 128 and the laser component 126 may be positioned downhole from the additional tools 127. In other embodiments, however, the stimulation tool 128 and the laser component 126 may be positioned uphole from the one or more additional downhole tools 127 or interposing one or more of the additional tools 127. Additionally, the additional downhole tools 127 may be positioned between the laser component 126 and the stimulation tool 128. In some instances, it may be desirable to include more than one laser component 126 and one or more stimulation tools 128 within the assembly 124. All of the components included in the assembly 124 may be operatively coupled by means of connection including, but not limited to, threaded engagement or rotary connections. As used herein, the term "operatively coupled," and any variations thereof, refers to a direct or indirect coupling between two component parts.

As shown, the assembly 124 may be conveyed into the wellbore 110 on the conveyance 125 until reaching a desired location. The assembly 124 may be conveyed through the interior of the production tubing 112 and into the open-hole section 122 where it is axially aligned with portions of the producible reservoir 108 selected for stimulation and sampling.

The laser component 126 may comprise a body 130 configured to contain or house a laser generator 132 within the interior of the body 130. The laser generator 132 may comprise components operable to create (generate) and ultimately emit at least one (and in some embodiments, more than one) laser beam 134. In some embodiments the laser generator 132 may include necessary components to generate the laser beam 134 with laser technologies such as solid-state lasers, fiber lasers, and/or diode lasers. In some embodiments, some or all of the components of the laser generator 132 may be disposed about the exterior of the body 130.

The body 130 may further include an orifice 140 defined within and through a sidewall of the body 130 of the laser component 126. The orifice 140 may provide a location where the laser beam 134 may be emitted from the laser generator 132. In other embodiments, the orifice 140 may be replaced with another delivery system designed to direct the laser beam 134 where desired. Other delivery systems may include the use of fiber optics, waveguides, or other mechanisms operable to emit (discharge) the laser beam 134 from the laser component 126, or more particularly, from the laser generator 132, and into the producible reservoir(s) 108.

The laser component 126 may also include an optics system (not shown). The optics system may include various optical elements to manipulate and control various characteristics of the laser beam 134 including size, shape, divergence, and focus. The optics system of the laser component 126 may also help optimize the energy of the laser generator 132 to ensure efficient interaction between the laser beam 134 and the producible reservoir(s) 108. The laser component 126 may also include various control systems operable to control the operating parameters of the laser generator 132 including the power, pulse duration, repetition rate and characteristics of the emitted laser beam 134.

Once the laser component 126 is aligned (arranged) at a desired location within the wellbore 110, the laser generator 132 may be activated to generate the laser beam 134, which emits outwardly from the laser component 126 (e.g., via the orifice 140) through the wellbore 110, and into the adjacent producible reservoir(s) 108. The laser beam 134 is emitted in the form of high-energy laser pulses resulting in the generation of a plurality of micro-fractures 141.

The laser component 126 may be programmable by an operator based on previously acquired formation data and/or operator assumptions. Characteristics that may be considered include, but are not limited to, formation type, mineralogy, formation porosity, formation permeability, and mechanical properties of the formation, etc. The operator may input operational parameters based upon the characteristics of the formation 106. Programmable operational parameters include but are not limited to power, intensity, pulse duration, wavelength, repetition rate, and tool rotation, etc. In some embodiments the laser intensity may be selectively varied (or may be programmed to vary) from several hundred watts per square centimeter ($W/cm^2$) to several kilowatts per square centimeter ($kW/cm^2$). In some embodiments, the laser component 126 may be operable to exert power that may range between about 1 kW and 1200 kW.

In some embodiments, the laser generator 132 may be operatively coupled to a cable 136 configured to transmit laser energy (power) from a laser source 138. In one embodiment, the cable 136 may be extended through the interior bodies of the stimulation tool 128, the additional downhole tools 127 and the laser component 126, so that the cable 136 may be operatively coupled to the laser generator 132 positioned within the interior body 130. In such embodiments, when the downhole assembly 124 is conveyed through the production tubing 120, the cable 136 is also simultaneously conveyed through the interior of the production tubing 120. In embodiments where the conveyance 125 comprises wired coiled tubing, the cable 136 may be embedded within the walls of the conveyance 125. Accordingly, when the uppermost portion of the downhole assembly 124 is connected to the end of the conveyance 125 (e.g., the lowest portion of the wired coiled tubing) the cable 136 is able to transmit laser energy (power), through the walls of the conveyance 125 to the laser component 126 so that it may be operable to emit laser beam(s) 134. As used herein, the term "operatively coupled," and any variations thereof, refers to a direct or indirect coupling between two component parts.

Once emitted (discharged), the laser beam 134 may achieve a depth of penetration ranging from several fractions of an inch to a few inches. The depth of penetration may vary depending upon the characteristics of the formation 106 and producible reservoir(s) 108 as well as the operational parameters of the laser component 126.

In some embodiments, the laser source 138 may be positioned at the terranean surface 104 and the cable 136 extends therefrom. The laser source 138 powers the laser generator 132, which creates the laser beam 134. In some instances, the laser source 138 may be mounted on a truck or trailer to allow for ease of transportation. In other embodiments, the laser source 138 may be permanently installed on the terranean surface 104. In other embodiments, the laser source 138 may be integrated into the laser component 126. In any embodiment, once executed by an operator (located at the well location or remotely), the laser source 138 transmits the necessary power/energy through the cable 136 and to the laser generator 132, which creates and emits the laser beam 134 in the form of high-energy laser pulses.

In some embodiments, the cable 136 may comprise a fiber optic cable. In such embodiments, the laser source 138 may be operable to create the laser energy transmitted through the cable 136 to the body 130. The transmitted laser energy is then emitted from the body 130 via the orifice 140 in the form of the laser beam 134. Accordingly, in such embodiments, the laser component 126 would not include a laser generator 132 disposed in or about the body 130, and thus may provide the operator with flexibility in selecting more powerful or specialized laser generation capabilities than when restricted to a laser generator 132 disposed within, or about, the body 130 of the laser component 126.

In some embodiments, the laser component 126 may be activated in portions of the wellbore 110 that include production tubing 120. In such embodiments, the laser component 126 may be operable to first perforate (penetrate) the production tubing 120 and then enter the formation 106 and/or the reservoir 108 where the emitted laser beam(s) 134 may initiate micro-fractures 141 or propagate existing micro-fractures 141. In such embodiments, the laser beam 134 may travel through the production tubing 120 and into the formation 106 and/or the reservoir 108.

The stimulation tool 128 may comprise an acoustic component 142 and a fluid sampling component 144. In the example, the acoustic component 142 and the fluid sampling component 144 are integral to the stimulation tool 128. In some embodiments, the stimulation tool 128 may include more than one acoustic component 142 and more than one auto-sampling component 130.

The acoustic component 142 may include one or more acoustic generators 146. In some embodiments, the acoustic generators 146 may be disposed within the interior of the acoustic component 142 but could alternatively be arranged about the exterior of the acoustic component 142. Once the stimulation tool 128 is aligned (arranged) at a desired location within the wellbore 110, the acoustic generators 146 may be activated to generate and emit acoustic waves 148, which propagate radially outward from the acoustic component 142, through the wellbore 110, and into the radially adjacent producible reservoir(s) 108. In some applications, the generated acoustic waves 148 may help clean adjacent portions of the wellbore 110. In such applications, the acoustic waves 148 assist in clearing clogged portions of the near-wellbore region that may experience a buildup of debris as the wellbore 110 is produced.

According to the example embodiment disclosed herein, the stimulation tool 128 may be used to stimulate the same portion of the producible reservoir(s) 108 previously treated (stimulated) by the laser component 126. In doing so, the acoustic waves 148 emitted by the acoustic component 142 may further propagate the micro-fractures 141 initially created by the laser component 126. In some embodiments, the conveyance 125 may be advanced within the wellbore 110 to align the acoustic component 142 with the portion of the formation 106 previously stimulated by the laser component 126. In other embodiments, the stimulation tool 128 may stimulate portions uphole or downhole from the portion of reservoir 108 previously stimulated by the laser component 126.

The frequency of the acoustic waves 148 may be optimized to further induce a plurality (network) of micro-fractures 141 extending radially outward from the wellbore 110. More specifically, the acoustic generator(s) 146 may be configured to emit the acoustic waves 148 over a range of frequencies, programmable by an operator, and based on previously acquired formation data and/or operator assumptions. In one embodiment, the acoustic generator(s) 132 may be operable to emit both low frequency and high frequency acoustic waves 148. The initial frequency of the emitted acoustic waves 148 may be informed by data including, but not limited to, previously acquired formation information (via formation evaluation logs), offset reservoir data and operational requirements that may include a desired measurement resolution.

Acoustic waves 148 with high (or higher) frequencies (e.g., >20 kHz) (often referred to as "ultrasonic waves") may induce micro-fractures 141 that extend radially from the wellbore 110 and into the near-wellbore region and potentially some distance beyond the near-wellbore region. The radial depth of the near-wellbore region may vary based upon factors including, but not limited to, well specific characteristics and reservoir specific characteristics. The radial depth of the near-wellbore region may vary based upon factors including, but not limited to, well specific characteristics and reservoir specific characteristics.

In contrast, low frequency acoustic waves 148 (e.g., <20 kHz) (often referred to as "infrasonic waves") may be able to create micro-fractures 141 extending radially from the wellbore 110 but penetrating to a "deeper depth" than generally penetrated via high frequency acoustic waves 148 and conventional stimulation tools. In the example disclosed herein, the acoustic generators 146 may be operable to emit low frequency acoustic waves 148 that penetrate radially at least 20 ft from the wellbore 110. By emitting low frequency acoustic waves 148, micro-fractures 141 may be induced (generated) at deeper depths (i.e., radially extending 20 ft or more from the wellbore 110) in unconventional producible reservoirs 108.

The micro-fractures 141, once induced, may continue to propagate naturally over time. Additionally, the generated micro-fractures 141 may retain their stability, particularly in tight formations. In one embodiment, the acoustically induced micro-fractures 136 may be further propagated with proppant positioned during a subsequent hydraulic fracture treatment.

In addition to adjusting and optimizing the frequency of the acoustic waves 148 emitted by the acoustic generators 146, the acoustic component 142 may be operable to control and vary the intensity (in Watt/meter$^2$ or "W/m$^2$") of the acoustic waves 148 emitted. In varying the power (W) exerted by the acoustic component 142, the intensity of the acoustic waves 148 changes thereby allowing the operator to control the size and extent of the resulting micro-fractures 141. More particularly, the operator may be able to control the length, width, and depth of penetration of the micro-fractures 141 by optimizing the intensity of the acoustic waves 148 emitted from the acoustic generators 146. Like the initial programming of the frequency of the acoustic waves 148, the operator may be able to program the acoustic generators 146 to emit the acoustic waves 148 at an intensity informed by previously acquired formation data and/or assumptions. In some embodiments, the intensity levels of the acoustic waves 148 may range from several kilowatts per square centimeter ($W/cm^2$) to several hundred $W/cm^2$. Accordingly, the power (W) levels of the acoustic component 142 may be varied in ranges from 5,000 to 10,000 W.

In some embodiments, like the laser component 126, the acoustic generators 146 may be activated in portions of the wellbore 110 that include production tubing 120. In such embodiments, the acoustic waves 148 may propagate through the production tubing 120 and travel into the formation 106 and/or the reservoir 108.

The acoustic component 142 may further include one or more acoustic sensors or receivers 150. The acoustic receivers 150 may be operable to detect portions of the acoustic waves 148 reflected back from the formation 106, referred to herein as reflected acoustic waves 152. The reflected acoustic waves 152 are the result of the emitted acoustic waves 148 "bouncing off" or "reflecting" off the formation 106 and/or the reservoir(s) 108. Once received by the acoustic receivers 150, data representative of the reflected acoustic waves 152 may be transmitted to a server 143 (e.g., located at the surface 104) and connected to a workstation (not shown) that may be utilized by an operator. The operator may analyze the received data from the stimulation tool 128 to determine if micro-fractures 141 were successfully formed in the surrounding formation 106. More particularly the data collected may include identifiable characteristics that may be transmitted to the server 143 from which the operator may interpret (or indicate to the operator) that micro-fractures 141 were acoustically induced.

Where micro-fractures 141 are identifiable, the analysis of the reflected acoustic waves 152 may further identify characteristics and/or properties about the micro-fractures 141 as well as characteristics and/or properties of the producible reservoir 108 itself. Properties or characteristics of the micro-fractures 141 that may be analyzed and/or characterized include, but are not limited to, geometry (e.g., width, length, height, gap, etc.) and the connectivity between micro-fractures 141, which may be indicative of the permeability and porosity of the producible reservoir 108. The characteristic information informed by reflected acoustic waves 152 may provide insight as to the performance of the previously executed laser component 126 stimulation. The reflected acoustic waves 152 may provide information about the micro-fractures 141 potentially generated by the laser beam(s) 134 as well as information about the producible reservoir(s) 108 including changes in stresses and any alteration to the near-wellbore region.

Based on the analysis of the reflected acoustic waves 152, a second emission (discharge) of acoustic waves 148 may be necessary and/or desirable. In such applications, the operator may direct the acoustic generators 146 to generate a second emission of acoustic waves 148 optimized in frequency and/or intensity, as informed by the analysis of the reflected acoustic waves 152. Upon their return, the second set of reflected acoustic waves 152 may again be analyzed for optimization. This process may be repeated as many times as the operator deems necessary. In some embodiments, the first emission of acoustic waves 148 may result in optimized micro-fractures 141 thereby negating the need for multiple acoustic waves 148 emissions.

In some embodiments, the acoustic generators 146 and the acoustic receivers 150 may be combined into a single device or otherwise replaced with acoustic transducers operable to both emit acoustic waves 148 and receive reflected acoustic waves 152.

In some embodiments, the acoustic component 142 may be operable for both the generation of micro-fractures 141 and for cleanup of the reservoir 108. In such embodiments, the acoustic waves 148 may be emitted at a frequency at or above 20 kHz thereby clearing the near wellbore area of blockages that may be due to the presence of paraffin, asphaltenes and similar. In other embodiments, near wellbore cleanup may be accomplished with acoustic waves 148 emitted at a frequency less than 20 KHz.

In addition, the acoustic component 142 may be operated for the purpose of near wellbore cleanup. Accordingly, the operator may adjust the frequency of the acoustic waves 148 to target an area of the surrounding reservoir 108 that is closest to the wellbore 110.

The fluid sampling component 144 may be operable to extract fluid samples in conjunction with operation of the acoustic component 142 and from the wellbore 110 at locations radially adjacent to the reservoir(s) 108. In some embodiments, the fluid sampling component 144 may be configured to both collect and store samples of reservoir fluids (e.g., crude oil, natural gas, formation water) that may be drawn directly from the producible reservoirs 108 (or otherwise), for future analysis. In other embodiments, the fluid sampling component 144 may be configured to collect samples of reservoir fluids for real-time analysis. In yet other embodiments, the fluid sampling component 144 may be configured to do both. However, the fluid sampling component 144 may not be operable when the assembly 124 is positioned within the production tubing 120.

In some embodiments, the fluid sampling component 144 may include one or more probes (not shown) configured to extend from the fluid sampling component 144 to make physical contact with an inner wall of the open-hole section 122 of the wellbore 110 and thereby extract a sample of fluid. In other embodiments, the fluid sampling component 144 may include one or more apertures or inlet ports (not shown) configured to draw in fluid samples from within the wellbore 110. In some embodiments, the fluid sampling component 144 may be programmed to operate automatically (in real-time) when certain thresholds are met (e.g., following execution of the laser component 126, following the analysis of reflected acoustic waves 152, upon detecting a permeability above a certain level, etc.). In other embodiments, however, the fluid sampling component 144 may be selectively operated by a user or operator located on the terranean surface 104 as desired.

As mentioned above, in some embodiments, the fluid sampling component 144 may extract a sample from the reservoir 108 and retain (store) the sample within the interior of the fluid sampling component 144 so that the fluid sample may be analyzed at surface 104. In such embodiments, the conveyance 125 may be retracted to surface 104 so that samples stored within the fluid sampling component 144 may be retrieved and analyzed for the purpose of characterizing the fluids/substances collected.

In other embodiments, however, the fluid sampling component 144 may include on-board analysis devices and systems capable of analyzing the captured fluid samples in real-time once collected. In such embodiments, the real-time data may be transmitted to the server 143 so that the results may be observed and/or analyzed by an operator at the surface 104. The real-time fluid analysis may provide information about the reservoir 108 including pressure, temperature, salinity, and saturation. Additionally, the operator may utilize the real-time fluid analysis data to configure (or reconfigure) the location of the acoustic component 142 and/or the laser component 126. Similarly, the fluid analysis may inform an adjustment in the frequency and/or intensity of the acoustic waves 148 to be emitted as well as the operational parameters of the laser generator 132. In either scenario, the fluid samples may be useful in identifying an optimized location(s) to position and activate the acoustic component 142 as well as the laser component 126.

Analysis of the fluid samples may also be beneficial in optimizing the production of the producible reservoirs 108. Accordingly, in at least one embodiment, the fluid sampling component 144 may be operable and otherwise programmed to collect and analyze the reservoir fluid both before and after the acoustic component 142 is activated. In another embodiment, the fluid sampling component may be programmed to collect and analyze the reservoir fluid both before and after the laser component 126 is activated. Analysis of the reservoir fluid post-emission of the acoustic waves 148 and the laser beam 134 may inform the effectiveness of both the acoustic waves 148 and the laser beam 134 emitted. Analysis of the fluid post-emission of the acoustic waves 148 and laser beam 134 may also provide information about the width of the induced micro-fractures 141 and their extent of penetration within the reservoir(s) 108 as well as fracture connectivity and communication.

Accordingly, the reservoir fluid analysis may effectuate reconfigured acoustic wave 148 emission (e.g., adjusted frequency, intensity) as well as reconfigured laser beam 134 emission (e.g., adjusted power, pulse duration, wavelength, repetition rate, laser beam characteristics, and tool rotation) from the respective components (i.e., the acoustic component 142 and the laser component 126). Alternatively, fluid analysis post-emission of the acoustic waves 148 and laser beam(s) 134 may indicate whether additional or other treatments is/are necessary. Other treatments may include, but are not limited to, acid matrix treatments.

Figure 2:
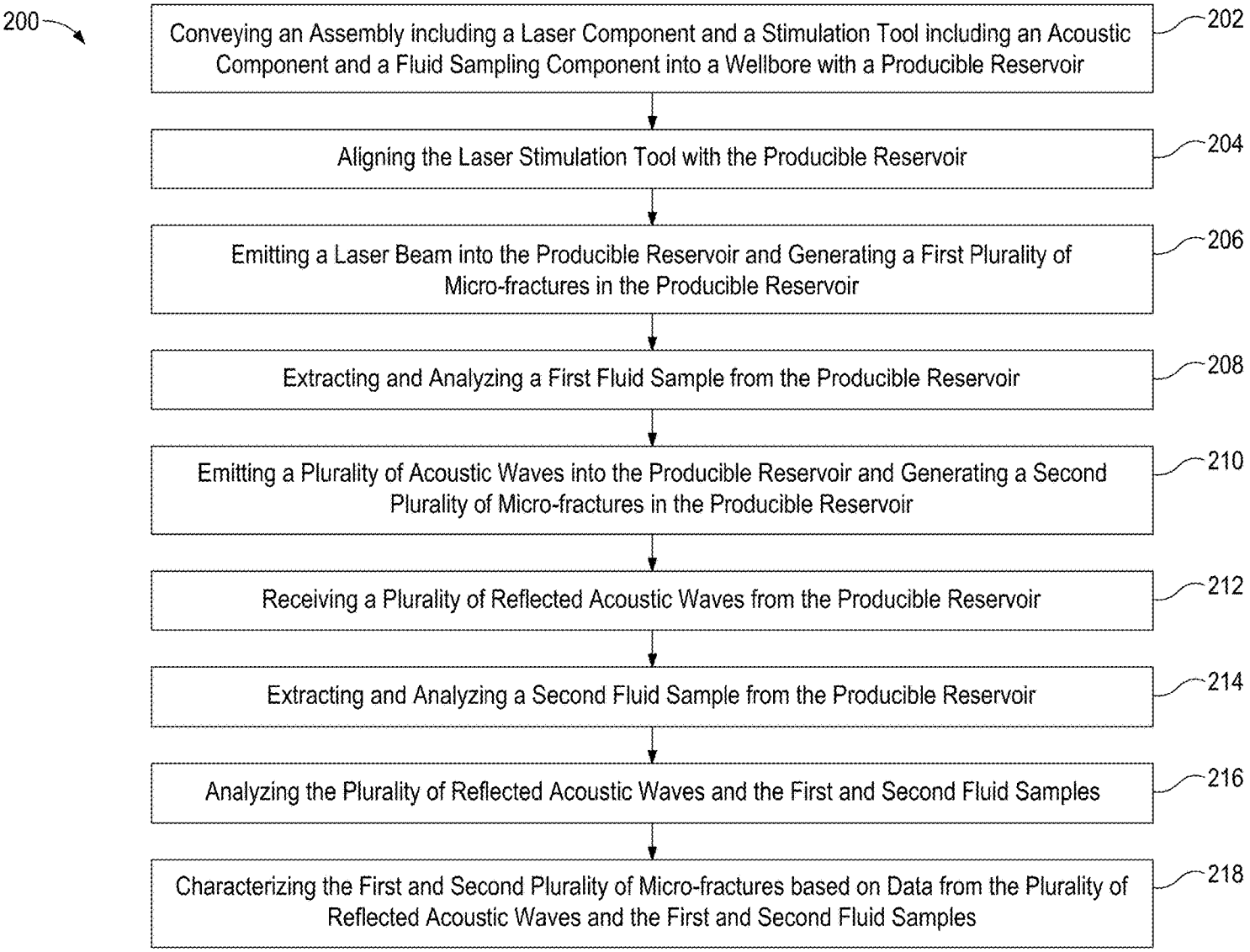
FIG. 2 is a schematic flowchart of an example wellbore stimulation operation method, according to one or more embodiments.

FIG. 2 is a schematic flowchart of an example wellbore stimulation operation method 200, according to one or more embodiments. The method 200 may include conveying a downhole assembly into a wellbore penetrating a producible reservoir, wherein the downhole assembly may include a laser component and a stimulation tool that includes an acoustic component and an auto-sampling component, as at 202. The laser component may include a laser generator operable to generate and emit a laser beam into the producible reservoir, and the laser generator may be programed to emit a laser beam of a predetermined size, shape, divergence, and focus. The acoustic component may include one or more acoustic generators operable to emit acoustic waves and one or more acoustic receivers operable to receive a plurality of reflected acoustic waves returning from the producible reservoir. The acoustic component may be programed to emit acoustic waves at predetermined frequencies and intensities.

The method 200 may further include aligning the laser component with a first producible reservoir within the wellbore, as at 204. The method 200 may continue by emitting a laser beam into the producible reservoir and thereby generating a first plurality of micro-fractures, as at 206. In some embodiments, where the laser stimulation tool is positioned downhole from the acoustic component, the downhole assembly may be conveyed further into the wellbore so that the acoustic component may be aligned with the first producible reservoir.

The method 200 may further include extracting and analyzing a first fluid sample from the producible reservoir, as at 208. In some instances, fluid analysis may prompt a reconfiguration of the acoustic component, thereby adjusting the frequency and/or intensity of the acoustic waves that are emitted. In other instances, the fluid analysis may indicate that the acoustic component is configured properly.

The method 200 may then include emitting a plurality of acoustic waves from the acoustic component, as informed by the fluid analysis, into the producible reservoir and thereby generating a second plurality of micro-fractures, as at 210. The method 200 may then include receiving a plurality of reflected acoustic waves with the one or more acoustic receivers from the producible reservoir, as at 212. In some instances, the reflected acoustic waves may be analyzed to direct a second emission of acoustic waves. In other instances, the method 200 may continue with extracting and analyzing a second fluid sample from the producible reservoir, as at 214.

The method 200 may include analyzing the plurality of reflected acoustic waves as well as the first and second fluid samples, as at 216. Lastly, the method 200 may include characterizing the first and second plurality of micro-fractures generated based on data obtained by the plurality of reflected acoustic waves and the first and second fluid samples, as at 218. The method 200 may be repeated as many times as the operator deems necessary and at any depth in the wellbore.

Embodiments disclosed herein include:

A. A well system, including a wellbore extending from a wellhead and penetrating a producible reservoir and a downhole assembly extendable into the wellbore and including a laser component operable to emit a laser beam into the producible reservoir to induce a first plurality of micro-fractures extending radially outward from the wellbore. The downhole assembly further including a stimulation tool that includes an acoustic component including one or more acoustic generators operable to generate and propagate acoustic waves into the producible reservoir and thereby induce a second plurality of micro-fractures extending radially outward from the wellbore, and one or more acoustic receivers operable to detect and receive reflected acoustic waves returned back from the producible reservoir and a fluid sampling component operable to extract fluid samples from the wellbore at locations radially adjacent the producible reservoir, wherein data related to the reflected acoustic waves and the fluid samples is analyzed to characterize the first and second pluralities of micro-fractures.

B. A wellbore stimulation method, including conveying a downhole assembly into a wellbore penetrating a producible reservoir, the downhole assembly including a laser component that includes a laser generator, and a stimulation tool that includes an acoustic component including one or more acoustic generators and one or more acoustic receivers and a fluid sampling component. The method including aligning the laser stimulation tool with the producible reservoir within the wellbore, emitting a laser beam from the laser generator and thereby generating a first plurality of micro-fractures in the producible reservoir. The method including extracting and analyzing a first fluid sample from the wellbore with the fluid sampling component at a location adjacent to the producible reservoir, emitting a plurality of acoustic waves from the one or more acoustic generators and thereby generating a second plurality of micro-fractures in the producible reservoir, and receiving a plurality of reflected acoustic waves with the one or more acoustic receivers from the producible reservoir. The method including extracting and analyzing a second fluid sample from the wellbore with the fluid sampling component at the location, analyzing the plurality of reflected acoustic waves and the first and second fluid samples and characterizing the first and second plurality of micro-fractures generated in the producible reservoir based on data obtained by the plurality of reflected acoustic waves and the first and second fluid samples.

C. A downhole assembly, including a laser component that includes a laser generator operable to generate and emit a laser beam into a producible reservoir and thereby induce a first plurality of micro-fractures and a stimulation tool that includes an acoustic component including one or more acoustic generators operable to generate and propagate acoustic waves and thereby induce a second plurality of micro-fractures in the producible reservoir, and one or more acoustic receivers operable to detect and receive reflected acoustic waves returned back from the one or more producible reservoirs. The downhole assembly further including a fluid sampling component operable to extract fluid samples from the wellbore at locations radially adjacent to the one or more producible reservoirs.

Each of embodiments A through C may have one or more of the following additional elements in any combination: Element 1: wherein the data related to the reflected acoustic waves includes data related to the emitted laser beam. Element 2: wherein the laser component includes a body that houses a laser generator operable to generate the laser beam and an orifice defined in the body and through which the laser beam is emitted. Element 3: wherein the laser generator is programmable to adjust one or more characteristics of the laser beam including power, pulse duration, and wavelength. Element 4: wherein a power exerted by the laser component ranges between about 1 kW and 1200 kW. Element 5: wherein the laser generator is operatively coupled to a laser source with a cable that transmits laser energy from the laser source to the laser generator. Element 6: wherein a frequency of the acoustic waves ranges between about 2 kHz and about 20 kHz. Element 7: wherein the acoustic component is operable to adjust a frequency of the acoustic waves in real-time and thereby control a size and extent of the second plurality of micro-fractures. Element 8: wherein the one or more acoustic generators are operable to generate the acoustic waves at or about 20 kHz to thereby induce the second plurality of micro-fractures. Element 9: wherein the one or more acoustic generators are operable to generate the acoustic waves at a frequency less than 2 kHz. Element 10: wherein the acoustic component is operable to adjust an intensity of the acoustic waves in real-time and thereby control a size and extent of the second plurality of micro-fractures. Element 11: wherein an analysis of the reflected waves identifies at least one of geometry and connectivity of the first and second pluralities of micro-fractures. Element 12: wherein the one or more acoustic generators and the one or more acoustic receivers comprise a single device.

Element 13: wherein emitting the plurality of acoustic waves from the one or more acoustic generators comprises emitting the plurality of acoustic waves at a frequency of ranging between about 2 kHz and about 20 kHz. Element 14: wherein analyzing the plurality of reflected acoustic waves comprises identifying at least one of geometry and connectivity of the plurality of micro-fractures. Element 15: the method further including emitting a second laser beam from the laser generator into the producible reservoir, the second laser beam differing from the first laser beam in at least one of an intensity, a pulse duration and a wavelength, emitting a second plurality of acoustic waves from the one or more acoustic generators, wherein the second plurality of acoustic waves differs from the first plurality of acoustic waves in at least one of a frequency and an intensity, receiving a second plurality of reflected acoustic waves from the producible reservoir, and analyzing the second plurality of acoustic waves.

Element 16: wherein a power exerted by the laser component ranges between about 1 kW and 1200 kW. Element 17: wherein the acoustic generators emit acoustic waves ranging between about 2 kHz and about 20 kHz.

By way of non-limiting example, exemplary combinations applicable to A through C include: Element 2 with Element 3.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative

The invention claimed is:

1. A well system, comprising:

a wellbore extending from a wellhead and penetrating a producible reservoir; and a downhole assembly extendable into the wellbore and including a laser component operable to emit a laser beam into the producible reservoir to induce a first plurality of micro-fractures extending radially outward from the wellbore, and a stimulation tool that includes:

an acoustic component including one or more acoustic generators operable to generate and propagate acoustic waves into the producible reservoir and thereby induce a second plurality of micro-fractures extending radially outward from the wellbore, and one or more acoustic receivers operable to detect and receive reflected acoustic waves returned back from the producible reservoir; and a fluid sampling component operable to extract fluid samples from the wellbore at locations radially adjacent the producible reservoir, wherein data related to the reflected acoustic waves and the fluid samples is analyzed to characterize the first and second pluralities of micro-fractures.

2. The well system of claim 1, wherein the data related to the reflected acoustic waves includes data related to the emitted laser beam.

3. The well system of claim 1, wherein the laser component includes:

a body that houses a laser generator operable to generate the laser beam; and an orifice defined in the body and through which the laser beam is emitted.

4. The well system of claim 3, wherein the laser generator is programmable to adjust one or more characteristics of the laser beam including power, pulse duration, and wavelength.

5. The well system of claim 1, wherein a power exerted by the laser component ranges between about 1 kW and 1200 kW.

6. The well system of claim 1, wherein the laser generator is operatively coupled to a laser source with a cable that transmits laser energy from the laser source to the laser generator.

7. The well system of claim 1, wherein a frequency of the acoustic waves ranges between about 2 kHz and about 20 kHz.

8. The well system of claim 1, wherein the acoustic component is operable to adjust a frequency of the acoustic waves in real-time and thereby control a size and extent of the second plurality of micro-fractures.

9. The well system of claim 1, wherein the one or more acoustic generators are operable to generate the acoustic waves at or about 20 kHz to thereby induce the second plurality of micro-fractures.

10. The well system of claim 1, wherein the one or more acoustic generators are operable to generate the acoustic waves at a frequency less than 2 kHz.

11. The well system of claim 1, wherein the acoustic component is operable to adjust an intensity of the acoustic waves in real-time and thereby control a size and extent of the second plurality of micro-fractures.

12. The well system of claim 1, wherein an analysis of the reflected waves identifies at least one of geometry and connectivity of the first and second pluralities of micro-fractures.

13. The well system of claim 1, wherein the one or more acoustic generators and the one or more acoustic receivers comprise a single device.

14. A wellbore stimulation method, comprising:

conveying a downhole assembly into a wellbore penetrating a producible reservoir, the downhole assembly including a laser component that includes a laser generator, and a stimulation tool that includes:

an acoustic component including one or more acoustic generators and one or more acoustic receivers; and a fluid sampling component;

aligning the laser stimulation tool with the producible reservoir within the wellbore;

emitting a laser beam from the laser generator and thereby generating a first plurality of micro-fractures in the producible reservoir;

extracting and analyzing a first fluid sample from the wellbore with the fluid sampling component at a location adjacent to the producible reservoir;

emitting a plurality of acoustic waves from the one or more acoustic generators and thereby generating a second plurality of micro-fractures in the producible reservoir;

receiving a plurality of reflected acoustic waves with the one or more acoustic receivers from the producible reservoir;

extracting and analyzing a second fluid sample from the wellbore with the fluid sampling component at the location;

analyzing the plurality of reflected acoustic waves and the first and second fluid samples; and characterizing the first and second plurality of micro-fractures generated in the producible reservoir based on data obtained by the plurality of reflected acoustic waves and the first and second fluid samples.

15. The method of claim 14, wherein emitting the plurality of acoustic waves from the one or more acoustic generators comprises emitting the plurality of acoustic waves at a frequency of ranging between about 2 kHz and about 20 kHz.

16. The method of claim 14, wherein analyzing the plurality of reflected acoustic waves comprises identifying at least one of geometry and connectivity of the plurality of micro-fractures.

17. The method of claim 14, the method further comprising:

emitting a second laser beam from the laser generator into the producible reservoir, the second laser beam differing from the first laser beam in at least one of an intensity, a pulse duration, and a wavelength;

emitting a second plurality of acoustic waves from the one or more acoustic generators, wherein the second plurality of acoustic waves differs from the first plurality of acoustic waves in at least one of a frequency and an intensity;

receiving a second plurality of reflected acoustic waves from the producible reservoir; and analyzing the second plurality of acoustic waves.

18. A downhole assembly, comprising:

a laser component that includes a laser generator operable to generate and emit a laser beam into a producible reservoir and thereby induce a first plurality of micro-fractures; and a stimulation tool that includes:

an acoustic component including one or more acoustic generators operable to generate and propagate acoustic waves and thereby induce a second plurality of micro-fractures in the producible reservoir, and one or more acoustic receivers operable to detect and receive reflected acoustic waves returned back from the one or more producible reservoirs; and a fluid sampling component operable to extract fluid samples from the wellbore at locations radially adjacent to the one or more producible reservoirs.

19. The downhole assembly of claim 18, wherein a power exerted by the laser component ranges between about 1 kW and 1200 kW.

20. The downhole assembly of claim 18, wherein the acoustic generators emit acoustic waves ranging between about 2 kHz and about 20 kHz.

* * * * *